United States Patent [19]

Hammond

[11] 4,071,798

[45] Jan. 31, 1978

[54] SODIUM VAPOR LAMP WITH EMISSION APERTURE

[75] Inventor: Thomas J. Hammond, Penfield, N.Y.

[73] Assignee: Xerox Corporation, Stamford, Conn.

[21] Appl. No.: 783,905

[22] Filed: Apr. 1, 1977

[51] Int. Cl.[2] ..... H01J 61/52

[52] U.S. Cl. ..... 313/18; 313/44; 313/46; 313/227; 313/113

[58] Field of Search ..... 313/11, 12, 18, 34, 313/44, 46, 113

[56] References Cited

U.S. PATENT DOCUMENTS

| | | | |
|---|---|---|---|
| 3,221,198 | 11/1965 | Vanderwal et al. | 313/25 |
| 3,821,578 | 6/1974 | Beck et al. | 313/44 |

*Primary Examiner*—Rudolph V. Rolinec

*Assistant Examiner*—Darwin R. Hostetter

*Attorney, Agent, or Firm*—Robert J. Bird

[57] ABSTRACT

A low pressure sodium vapor lamp including a sodium vapor discharge tube within an outer envelope. The outer envelope is partially coated by a light reflector defining a light transmission aperture for desired directional light output. The outer envelope is additionally coated with an infrared reflective coating defining a heat transmission aperture at a location separate from the light transmission aperture. The heat transmission aperture acts as a heat sink. The area of the inner discharge tube corresponding to the heat transmission aperture thus becomes the coolest portion of the discharge tube, the "cold spot" of the lamp where excess sodium is condensed.

3 Claims, 1 Drawing Figure

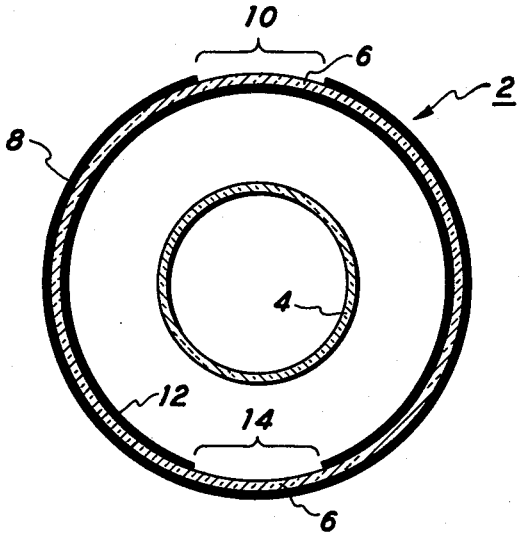
10
6
2
8
4
12
14
6

SODIUM VAPOR LAMP WITH EMISSION APERTURE

BACKGROUND OF THE INVENTION

This invention relates to sodium vapor lamps and in particular to a low pressure sodium vapor lamp for use as a xerographic exposure lamp.

Low pressure sodium vapor lamps have several desirable properties for application as exposure lamps in xerographic photocopiers. The spectral output of sodium lamps is almost monochromatic, emitting essentially at 589.0 and 589.6 nanometers, this in the yellow portion of the spectrum. As has been pointed out in U.S. Pat. No. 3,869,205, this yellow radiation is particularly desirable for creating object contrast for copying of most documents and paper work in general use. Furthermore, the efficiency of low pressure sodium lamps is relatively high and compares favorably with other linear light sources.

For xerographic application, there are certain characteristics of sodium lamps that present problems to be overcome. Excess metallic sodium is generally present within the lamp discharge tube to control the vapor pressure within the tube. This metallic sodium is opaque and absorbs some of the radiation from the sodium vapor discharge and to that extent lowers the lamp efficiency. Also, for most xerographic applications, it is desirable to direct the light emission from the exposure lamps onto a rectangular slit to minimize stray light.

In the prior art, as for example U.S. Pat. No. 3,221,198 to Van de Wal et al, the coating of a sodium vapor lamp tube with tin oxide for the purpose of visible transmission and infrared reflection, for the purpose of heat conservation, is known.

It is an object of the present invention to provide a sodium vapor discharge lamp with a combination of light reflective coating defining a light aperture to provide desired directionality of visible light emission and an infrared reflective coating defining a "cold spot" where excess sodium is condensed.

SUMMARY OF THE INVENTION

This invention is practiced in one form by a low pressure sodium vapor lamp including a sodium vapor dicharge tube within an outer envelope. The outer envelope is partially coated by a light reflector defining a light transmission aperture for desired directional light output. The outer envelope is additionally coated with an infrared reflective coating defining a heat transmission aperture at a location separate from the light transmission aperture. The heat transmission aperture acts as a heat sink. The area of the inner discharge tube corresponding to the heat transmission aperture thus becomes the coolest portion of the discharge tube, the "cold spot" of the lamp where excess sodium is condensed.

For a better understanding of this invention, reference is made to the following detailed description of an exemplary embodiment, given in connection with the accompanying drawing.

DRAWING

The single FIGURE is a schematic cross section of a low pressure sodium vapor lamp according to the present invention.

DESCRIPTION

Referring to the drawing, a sodium vapor discharge lamp is generally indicated in cross section at 2 and includes an inner discharge tube 4 within an outer transparent envelope 6. The glass inner discharge tube 4 contains sodium which, during lamp operation, may be in both vapor and condensed phases. Outer envelope 6 is coated on its exterior with a visible light reflective coating 8 which defines a light transmission aperture 10 along the length of the lamp. Outer envelope 6 is coated on its interior with an infrared reflective coating 12 which defines a heat transmission aperture 14 along the length of the lamp. Apertures 10 and 14 are shown as 180° apart on the lamp envelope. This is only illustrative; they may be located at other relative positions which might be dictated by other factors such as system geometry. It is only essential that apertures 10 and 14 not be in registry with respect to the lamp center line.

In operation, the sodium discharge lamp 2 functions in a known way to emit light in the inner discharge tube 4 by the passage through vaporized sodium of an electric discharge. The excess of metallic sodium within the discharge tube 4 functions to control the vapor pressure within the tube. Excess metallic sodium will condense at the coolest part of the discharge tube 4. In order to keep the optical path to the light aperture 10 clear of condensed sodium, the coolest part of the discharge tube is located in the opposite direction, i.e. in the direction of the heat transmission aperture 14. Aperture 14, being transmissive of infrared, acts as a heat sink in the system with the result that the portion of discharge tube 4 which is in registry with aperture 14 is the coolest portion, the "cold spot" of the discharge tube.

Examples of materials that may be used for the light reflective coating 8 are titanium dioxide, barium sulfate, and magnesium oxide.

Examples of materials that may be used for the infrared reflective coating 12 are tin oxide and indium oxide.

The foregoing description of certain embodiments of this invention is given by way of illustration and not of limitation. The concept and scope of the invention are limited only by the following claims and equivalents thereof which may occur to others skilled in the art.

What is claimed is:

1. A sodium vapor discharge lamp comprising an inner discharge tube within an outer envelope, said outer envelope having on the surface thereof a light-reflective coating defining a light aperture for the transmission of visible light in a desired direction and an infrared-reflective coating defining a heat aperture for the transmission of infrared radiation, said heat aperture disposed on an area of said outer envelope away from said light aperture, thereby to correspondingly locate the coolest area of said discharge tube, where any sodium condensation occurs, away from said light aperture.

2. A sodium vapor discharge lamp as defined in claim 1 in which said light-reflective coating is on the exterior, and said infrared-reflective coating is on the interior, of said outer envelope.

3. A sodium vapor discharge lamp comprising an inner discharge tube within an outer envelope, said outer envelope having on the outer surface thereof a light-reflective coating of a material selected from the group consisting of barium sulfate, titanium dioxide, and magnesium oxide, said light-reflective coating defining a light aperture for the transmission therethrough of visible light in a desired direction, said outer envelope having on the inner surface thereof an infrared-reflective coating of a material selected from the group consisting of tin oxide and indium oxide, said infrared-reflective coating defining a heat aperture for the transmission therethrough of infrared radiation, said heat aperture disposed on an area of said outer envelope away from said light aperture, thereby to correspondingly locate the coolest area of said discharge tube, where any sodium condensation occurs, away from said light aperture.

* * * * *